US010103483B2

(12) United States Patent
Haegele et al.

(10) Patent No.: US 10,103,483 B2
(45) Date of Patent: Oct. 16, 2018

(54) COAXIAL PLUG-IN CONNECTOR ARRANGEMENT

(71) Applicant: KATHREIN-Werke KG, Rosenheim (DE)

(72) Inventors: Werner Haegele, Stuttgart (DE); Erik Baechle, Filderstadt (DE); Guenter Waeller, Waiblingen (DE); Stefan Berger, Rohrdorf (DE); Thomas Haunberger, Bad Reichenhall (DE); Mario Guenther, Kolbermoor (DE); Manfred Stolle, Bad Aibling (DE)

(73) Assignee: KATHREIN-Werke KG, Rosenheim (DE)

( * ) Notice: Subject to any disclaimer, the term of this patent is extended or adjusted under 35 U.S.C. 154(b) by 0 days.

(21) Appl. No.: 15/224,717

(22) Filed: Aug. 1, 2016

(65) Prior Publication Data

US 2017/0133789 A1 May 11, 2017

Related U.S. Application Data

(63) Continuation of application No. PCT/EP2015/052070, filed on Feb. 2, 2015.

(30) Foreign Application Priority Data

Feb. 3, 2014 (DE) ..... 10 2014 101 297

(51) Int. Cl.
*H01R 13/627* (2006.01)
*H01R 24/38* (2011.01)
(Continued)

(52) U.S. Cl.
CPC ..... *H01R 13/6275* (2013.01); *H01R 24/38* (2013.01); *H01R 24/40* (2013.01); *H01R 2103/00* (2013.01)

(58) Field of Classification Search
CPC ..... H01R 13/5219; H01R 13/5202; H01R 13/6275; H01R 13/6273; H01R 13/5208; H01R 2103/00; H01R 24/40
(Continued)

(56) References Cited

U.S. PATENT DOCUMENTS 3,533,051 A * 10/1970 Ziegler, Jr. ..... H01R 9/0503 439/585
4,917,625 A 4/1990 Haile
(Continued)

FOREIGN PATENT DOCUMENTS

CN 102027645 4/2011
CN 102498619 6/2012
(Continued)

*Primary Examiner* — Hien Vu
(74) *Attorney, Agent, or Firm* — Lipsitz & McAllister, LLC

(57) ABSTRACT

A coaxial plug-in connector arrangement is provided having an electrically conductive outer sleeve, and an electrically conductive inner sleeve which is insertable into the outer sleeve in the axial direction and is electrically connectable to the outer sleeve. A first contact pin is insertable into the outer sleeve from a side facing away from the inner sleeve. A second contact pin is insertable into the inner sleeve from a side facing away from the outer sleeve. An insulating part in which an inner conductor part is mounted is located in the inner sleeve. The two contact pins are connectable to one another in an electrically conductive manner via the inner conductor part. An arresting element is mountable on one of the two sleeves before insertion of the inner sleeve into the outer sleeve. The inner sleeve is detachably fixable in the outer sleeve by means of the arresting element.

30 Claims, 7 Drawing Sheets

(51) Int. Cl.
*H01R 24/40* (2011.01)
*H01R 103/00* (2006.01)

(58) Field of Classification Search
USPC ..... 439/271, 357, 578, 584, 587
See application file for complete search history.

(56) References Cited

U.S. PATENT DOCUMENTS

| | | | | |
|---|---|---|---|---|
| 4,925,403 | A * | 5/1990 | Zorzy | H01R 13/6315 439/578 |
| 6,024,609 | A | 2/2000 | Kooiman et al. | |
| 6,863,565 | B1 | 3/2005 | Kogan et al. | |
| 7,309,247 | B1 | 12/2007 | Keating | |
| 7,892,004 | B2 | 2/2011 | Hertzler et al. | |
| 7,914,347 | B2 * | 3/2011 | Paulus | H01R 24/50 439/680 |
| 9,071,019 | B2 | 6/2015 | Burris et al. | |
| 2009/0264003 | A1 | 10/2009 | Hertzler et al. | |
| 2010/0279536 | A1 | 11/2010 | Paulus | |
| 2010/0304579 | A1 * | 12/2010 | Kisling | H01R 9/0515 439/63 |
| 2010/0304598 | A1 | 12/2010 | Kari | |
| 2011/0256759 | A1 | 10/2011 | Kunes et al. | |
| 2012/0108098 | A1 | 5/2012 | Burris et al. | |
| 2014/0322970 | A1 * | 10/2014 | Binder | H01R 13/629 439/578 |
| 2015/0024628 | A1 * | 1/2015 | Haegele | H01R 9/05 439/585 |

FOREIGN PATENT DOCUMENTS

| | | |
|---|---|---|
| CN | 103166009 | 6/2013 |
| DE | 3440043 | 5/1986 |
| DE | 4015092 | 11/1991 |
| DE | 20119980 | 3/2002 |
| DE | 102005034496 | 1/2007 |
| DE | 102011056466 | 6/2013 |
| EP | 1115179 | 7/2001 |
| EP | 2385585 | 11/2011 |
| EP | 2605338 | 6/2013 |
| EP | 2615699 | 7/2013 |
| GB | 2257572 | 1/1993 |
| WO | 2006/016941 | 2/2006 |
| WO | 2012/058039 | 5/2012 |
| WO | 2013013665 | 1/2013 |

* cited by examiner

COAXIAL PLUG-IN CONNECTOR ARRANGEMENT

This application is a continuation of international application number PCT/EP2015/052070 filed on Feb. 2, 2015 and claims the benefit of German application number 10 2014 101 297.6 filed on Feb. 3, 2014, which are incorporated herein by reference in their entirety and for all purposes.

BACKGROUND OF THE INVENTION

The invention relates to a coaxial plug-in connector arrangement having an electrically conductive outer sleeve and an electrically conductive inner sleeve, which is insertable into the outer sleeve in the axial direction and is electrically connectable to the outer sleeve, a first contact pin being insertable into the outer sleeve from the side facing away from the inner sleeve, and a second contact pin being insertable into the inner sleeve from the side facing away from the outer sleeve, and an insulating part in which an inner conductor part is mounted being located in the inner sleeve, and the two contact pins being connectable to one another in an electrically conductive manner via the inner conductor part.

Coaxial plug-in connector arrangements of the above-mentioned type are used to establish an electrical connection between a first coaxial cable and a second coaxial cable, or also between a coaxial cable and some other electrical module. An end region of the first coaxial cable may be inserted, with its inner conductor, which forms a first contact pin, into the outer sleeve in the axial direction from the side facing away from the inner sleeve, and in corresponding manner, the inner conductor of a second coaxial cable, which forms a second contact pin, may be inserted into the inner sleeve in the axial direction from the side facing away from the outer sleeve. The two contact pins may customarily be inserted into recesses in the inner conductor part and connected to one another in an electrically conductive manner via the inner conductor part. The outer conductors of the two coaxial cables may be electrically connected to the outer sleeve and to the inner sleeve, respectively, for example by means of a soldered connection, and the inner sleeve may subsequently be inserted into the outer sleeve, the inner sleeve electrically contacting the outer sleeve and thus establishing an electrical connection between the outer conductors of the two coaxial cables. In the same way, a coaxial cable may also be connected to an electrical module by means of coaxial plug-in connector arrangements of this type. The electrical module provides one of the two contact pins, and the coaxial cable, by way of the end region of its inner conductor, provides the other contact pin. The contact pin of the electrical module may be connected in an electrically conductive manner to the contact pin of the coaxial cable via the inner conductor part, and corresponding outer conductors of the module and of the coaxial cable may be connected to one another in an electrically conductive manner via the outer sleeve and the inner sleeve.

For the operating performance of the coaxial plug-in connector arrangements, it is important that preferably no passive intermodulation (PIM) occurs; i.e., there should be preferably no mutual impairment of electrical signals that are transmitted at different frequencies via the coaxial plug-in connector arrangements. The passive intermodulation is influenced, among other things, by the stability of the mechanical connection between the inner sleeve and the outer sleeve. Therefore, to obtain the highest possible mechanical stability, in many cases the inner sleeve is screwed into the outer sleeve. The screw connection reduces the risk of the inner sleeve moving relative to the outer sleeve and thus of impairing the electrical transmission quality. However, providing a screw connection involves considerable manufacturing costs and makes the handling of these types of coaxial plug-in connector arrangements more difficult.

A detent connection between the inner sleeve and the outer sleeve is proposed in DE 10 2011 056 466 A1, electrical contacting between the inner sleeve and the outer sleeve taking place only in the radial direction along the periphery of the inner sleeve, but contacting of the inner sleeve with the outer sleeve in the axial direction, i.e., in particular at the end face of the inner sleeve, being avoided. The electrical connection is established on the one hand via an annular bulge located on the inner sleeve, and on the other hand via a radial expansion of the inner sleeve situated at a distance from the annular bulge. At the same time, the radial expansion is used to establish a detent connection between the inner sleeve and the outer sleeve, in that an annular groove, into which a ring-shaped detent projection of the outer sleeve protrudes, is located in the region of the radial expansion.

It is an object of the present invention to improve a coaxial plug-in connector arrangement of the type mentioned at the outset in such a way that it is easy to handle and has low passive intermodulation.

SUMMARY OF THE INVENTION

For a coaxial plug-in connector arrangement of the generic kind, this object is achieved according to the invention in that the coaxial plug-in connector arrangement has an arresting element, which is mountable on one of the two sleeves before insertion of the inner sleeve into the outer sleeve, and which is adapted to be pushed onto the other of the two sleeves during or after insertion of the inner sleeve into the outer sleeve, the inner sleeve being detachably fixable in the outer sleeve by means of the arresting element.

In the coaxial plug-in connector arrangement according to the invention, in addition to the inner sleeve and the outer sleeve, an arresting element is used, by means of which the inner sleeve may be fixed in the outer sleeve and detached from the outer sleeve as needed. The arresting element thus reduces the risk of the inner sleeve moving relative to the outer sleeve after being inserted and thereby adversely affecting the electrical transmission quality of the coaxial plug-in connector arrangement. The coaxial plug-in connector arrangement according to the invention is therefore characterized by low passive intermodulation.

In the coaxial plug-in connector arrangement according to the invention, the arresting element may be mounted on the inner sleeve or on the outer sleeve in a first mounting stage. When the inner sleeve is subsequently inserted into the outer sleeve, the arresting element may be pushed onto the other of the two sleeves in order to fix the two sleeves relative to one another. The arresting element may already assume its end position during the insertion of the inner sleeve into the outer sleeve, or may be pushed into its end position after the insertion of the inner sleeve into the outer sleeve.

In the coaxial plug-in connector arrangement according to the invention, it may thus be provided, for example, that the arresting element is initially premounted on the inner sleeve. When the inner sleeve is then inserted into the outer sleeve, the arresting element is pushed far enough onto the outer sleeve in the axial direction that, by means of the arresting element, a detachable mechanical connection is achieved between the inner sleeve and the outer sleeve for fixing the inner sleeve in the outer sleeve.

It may also be provided that the arresting element is initially premounted on the outer sleeve. When the inner sleeve is then inserted into the outer sleeve, the arresting element is pushed far enough onto the inner sleeve, opposite to the insertion direction of the inner sleeve that, by means of the arresting element, a detachable mechanical connection is achieved between the inner sleeve and the outer sleeve for fixing the inner sleeve in the outer sleeve.

It is advantageous when the arresting element is adapted to be selectively mounted on the inner sleeve or on the outer sleeve before insertion of the inner sleeve into the outer sleeve, and is adapted to be pushed onto the other of the two sleeves during or after insertion of the inner sleeve into the outer sleeve, in that this simplifies assembly of the coaxial plug-in connector arrangement, since the user has the option of selecting the premounting of the arresting element that is optimal for the particular application.

The inner sleeve is advantageously nonrotatably fixable in the outer sleeve by means of the arresting element.

It is advantageous when the inner sleeve is adapted to be fixed in the outer sleeve by means of the arresting element so as to be axially immovable and non-rotatable.

In an advantageous embodiment of the invention, particularly simple selective premounting of the arresting element on the inner sleeve or on the outer sleeve is achieved in that the arresting element is adapted to be selectively pushed onto one of the two sleeves before the inner sleeve is inserted into the outer sleeve. In such an embodiment of the invention, the arresting element may thus be pushed onto the inner sleeve, for example, in a first stage, and subsequently also pushed onto the outer sleeve when the inner sleeve is inserted into the outer sleeve. However, the user also has the option of pushing the arresting element onto the outer sleeve in a first stage. When the inner sleeve is then inserted into the outer sleeve, the arresting element is also pushed onto the inner sleeve in order to fix the inner sleeve in the outer sleeve in a detachable manner.

It is advantageous when the arresting element surrounds at least one of the two sleeves, in particular both sleeves, in the circumferential direction, after the inner sleeve is inserted into the outer sleeve. In such a configuration, the arresting element forms a shell, for example a cylindrical shell, which completely surrounds at least one of the two sleeves in the circumferential direction after the inner sleeve is inserted into the outer sleeve. The arresting element advantageously surrounds both sleeves after the inner sleeve is inserted into the outer sleeve. This has the advantage that the outer sleeve and the inner sleeve are protected from environmental influences and mechanical damage in the region enclosed by the arresting element.

It is advantageous when the arresting element surrounds the inner sleeve and/or the outer sleeve in an electrically insulating manner.

In an advantageous embodiment of the invention, the arresting element is detachably lockable to the inner sleeve and/or to the outer sleeve. It may be provided, for example, that the arresting element may be pushed onto one of the two sleeves for the premounting, and locked to this sleeve. The arresting element may subsequently also be pushed onto the other of the two sleeves when the inner sleeve is inserted into the outer sleeve, and advantageously detachably locked to the same.

In a preferred embodiment of the invention, the arresting element has a plurality of detent wings, which are distributed over the circumference of the arresting element and interlock with associated locking elements of the inner sleeve and/or of the outer sleeve. The detent wings are deformable in the radial direction and are arranged in a distributed manner over the circumference of the arresting element. For example, it may be provided that the arresting element has three detent wings arranged at a spacing from one another in the circumferential direction. The detent wings interact in each case with an associated locking element in the sense of a locking connection. The locking elements may for example be in the form of locking depressions, into which in each case a locking tab of a detent wing enters. The locking elements may be located on the inner sleeve, so that the arresting element is lockable to the inner sleeve by means of the detent wings. Alternatively or in addition, it may be provided that the locking elements are located on the outer sleeve, so the arresting element is lockable to the outer sleeve.

It is especially advantageous when the arresting element has a plurality of first detent wings, which extend into a region between the inner sleeve and the outer sleeve and interlock with locking elements that are located on the inner side of the outer sleeve. The locking elements may here be configured in the form of a common annular groove, which is situated on the inner side of the outer sleeve.

Advantageously, the arresting element has a plurality of second detent wings, which are distributed over the circumference of the arresting element and engage with locking elements that are located on the outer side of the inner sleeve. To this end it is advantageous when the locking elements located on the outer side of the inner sleeve together form an annular collar extending over the entire circumference of the inner sleeve. The second detent wings may have in each case a locking recess, into which the annular collar enters.

Preferably, the first and second detent wings are arranged alternatingly with respect to one another in the circumferential direction of the arresting element. Thus in the circumferential direction, a first detent wing, which interacts with a locking element located on the outer sleeve on the inner side, is followed by a second detent wing, which interacts with a locking element located on the inner sleeve on the outer side.

It is advantageous when the arresting element is elastically and/or plastically deformable in the radial direction, at least in certain regions. In such an embodiment of the invention, for premounting on one of the two sleeves and/or when the arresting element is pushed onto the respective other sleeve of the two sleeves, the arresting element may be elastically and/or plastically deformed in the radial direction, at least in particular regions.

It is especially advantageous when the arresting element is adapted to be pressed onto the inner sleeve and/or onto the outer sleeve and/or is adapted to be pressed in between the inner sleeve and the outer sleeve. A press-fit connection between the outer sleeve and the arresting element and/or between the inner sleeve and the arresting element may be achieved in this way.

In a preferred embodiment of the invention, the arresting element has a plurality of flexible tongues. The flexible tongues allow the arresting element to be deformed in the radial direction, inwardly and/or outwardly, by means of a simple design. This type of deformation is advantageous in particular when the arresting element is pushed onto the inner sleeve or onto the outer sleeve for the premounting.

It is advantageous when the arresting element engages behind a retaining surface of the inner sleeve and/or of the outer sleeve in the axial direction. This increases the mechanical load capacity of the mechanical connection between the inner sleeve and the outer sleeve, which is achieved by means of the arresting element. The retaining surface is advantageously perpendicular to the longitudinal axis of the coaxial plug-in connector.

It may be provided, for example, that the inner sleeve and/or the outer sleeve has/have a radially outwardly facing step on which an engaging portion of the arresting element may engage.

In a preferred embodiment of the invention, particularly simple handling is achieved in that the arresting element is mountable on the inner sleeve and on the outer sleeve without the use of tools. In such an embodiment of the invention, no special tool is necessary for premounting the arresting element on one of the two sleeves, and for the final mounting of the arresting element on the two sleeves.

It may be provided that for the premounting, the arresting element may initially be pressed onto the outer sleeve and/or locked to the outer sleeve, and that when the inner sleeve is inserted into the outer sleeve, the arresting element may also be pressed onto the inner sleeve and/or locked to the inner sleeve.

It may also be provided that the arresting element may initially be pressed onto the inner sleeve and/or locked to inner sleeve, and that when the inner sleeve is inserted into the outer sleeve, the arresting element may also be pressed onto the outer sleeve or locked to the outer sleeve.

The arresting element preferably has has a plurality of deformable pressing wings that are arranged spaced apart from one another in the circumferential direction of the arresting element and can be pressed in between the inner sleeve and the outer sleeve. The pressing wings are arranged at a spacing from one another in the circumferential direction of the arresting element. For example, it may be provided that the arresting element has three pressing wings distributed uniformly over the circumference of the arresting element. Advantageously, the pressing wings each extend in the circumferential direction over an angular range of about 40° to 60°.

It is advantageous when the radial extent of the pressing wings before the pressing-in into an accommodating space extending between the inner sleeve and the outer sleeve is greater, at least in certain regions, than the radial extent of the accommodating space. In such an embodiment, the pressing wings have an oversize dimension and are compressed during insertion into the accommodating space. The pressing wings are here plastically or elastically deformable.

It may be provided that the pressing wings, before the pressing-in into the accommodating space extending between the inner sleeve and the outer sleeve, have a radial extent along their entire extent relative to the circumferential direction of the arresting element that is greater than the radial extent of the accommodating space. In such an embodiment, the pressing wings have, along their entire extent relative to the circumferential direction of the arresting element, an oversize dimension so that, over their entire extent, they are in face-to-face contact with the outer sleeve and the inner sleeve and are compressed.

Alternatively, it may be provided that the pressing wings have a plurality of radial elevations arranged at a spacing from one another in the circumferential direction of the arresting element, and, before the pressing-in into the accommodating space extending between the inner sleeve and the outer sleeve, have a radial extent in the region of the radial elevations that is greater than the radial extent of the accommodating space. In such an embodiment of the invention, the pressing wings have an oversize dimension in the region of their radially outwardly directed elevations and/or their radially inwardly directed elevations, and are compressed in the region of these elevations during insertion into the accommodation space. This facilitates the insertion of the pressing wings into the accommodating space, it being possible for the wings to be bent elastically or plastically in the region between the elevations during insertion into the accommodating space, in order to increase the force acting on the inner sleeve and the outer sleeve.

In a preferred embodiment of the invention, the inner sleeve in the inserted state contacts the outer sleeve only in at least one contact area of the outer sleeve which extends in the circumferential direction of the inner sleeve, and the inner sleeve may be acted on by the arresting element with an axial tensile force in the direction of the outer sleeve, the insulating part abutting against the outer sleeve with a stop surface, which protrudes beyond the free end of the inner sleeve in the axial direction. In such an embodiment of the invention, the inner sleeve, in the inserted state, is electrically connected to the outer sleeve only in at least one contact area, which extends in the circumferential direction of the inner sleeve, but electrical contact at the end face of the inner sleeve is avoided due to the insulating part protruding beyond the free end of the inner sleeve and forming a stop surface, which in the inserted state of the inner sleeve abuts on the outer sleeve. The front end region of the insulating part in the insertion direction thus forms a spacer element, which in the inserted state of the inner sleeve ensures spacing between the free end of the inner sleeve and the outer sleeve. To avoid an axial movement of the inner sleeve relative to the outer sleeve, the inner sleeve is acted on by the arresting element with an axial tensile force in the direction of the outer sleeve. The tensile force ensures that the end of the insulating part, which protrudes beyond the free end of the inner sleeve, maintains its position on the outer sleeve, thus that the insulating part is pressed against the outer sleeve by the arresting element. When the inner sleeve is inserted into the outer sleeve, the outer sleeve forms a stop by way of a bottom wall, for example, which is contacted by the stop surface of the insulating part which protrudes beyond the free end of the inner sleeve, even before the free end of the inner sleeve is able to contact the bottom wall of the outer sleeve in the axial direction.

It is advantageous when the insulating part abuts against the inner sleeve, preferably against an inner shoulder of the inner sleeve, with a rear stop surface, which faces away from the outer sleeve. In such a configuration, the insulating part is clamped between the inner sleeve and the outer sleeve under the action of the axial tensile force of the arresting element. This increases the mechanical load capacity of the coaxial plug-in connector arrangement, and avoids axial movements of the inner sleeve relative to the outer sleeve.

It is particularly advantageous when the inner sleeve in the inserted state electrically contacts the outer sleeve only in a single contact area, the contact area being situated on an inner side of the outer sleeve and surrounding the inner sleeve in the circumferential direction. Such a configuration is characterized by particularly low passive intermodulation, since in a configuration of this type, unintentional relative motions of the inner sleeve with respect to the outer sleeve in the axial direction or also in the circumferential direction at most result in very minor impairment of the electrical transmission quality of the coaxial plug-in connector arrangement.

The contact area of the outer sleeve extending along the periphery of the inner sleeve is advantageously configured as a cylindrical wall portion of the outer sleeve.

In an advantageous embodiment of the invention, the cylindrical wall portion of the outer sleeve is adjoined by a wall portion of the outer sleeve, which conically expands in the direction of the free end of the outer sleeve, the inner sleeve extending into the wall portion, and the conically expanding wall portion and the inner sleeve defining an annular space between them.

The conically expanding wall portion of the outer sleeve may be adjoined by a cylindrical wall portion in the direction of the free end of the outer sleeve.

In an advantageous embodiment of the invention, the outer sleeve has a rigid structure, so that it is practically nondeformable in the radial and axial directions.

It may be provided that the outer sleeve is connected in one piece to a housing wall of an electrical module. A first contact pin may be inserted into the outer sleeve, which is connected in one piece to the housing wall, via a through opening in the housing wall, the first contact pin being electrically connected to a second contact pin via the inner conductor part after the inner sleeve is inserted into the outer sleeve.

In a preferred embodiment of the invention, the arresting element has an electrically nonconductive spacing member, which is insertable between an end portion of the outer sleeve facing away from the first contact pin and a region of the inner sleeve, which region, in the inserted state, is surrounded by this end portion in the circumferential direction. The spacing member ensures that the end portion of the outer sleeve facing away from the first contact pin is not able to accidentally electrically contact the region of the inner sleeve which is surrounded by this end portion.

It is particularly advantageous when the spacing member may be pressed in between the end portion of the outer sleeve facing away from the first contact pin and the region of the inner sleeve, which is surrounded by this end portion. In such a configuration, the spacing member not only has the function of ensuring a distance between the end portion of the outer sleeve facing away from the first contact pin and the region of the inner sleeve which is surrounded by this end portion, but the spacing member also has the function of a clamping member, which ensures a mechanical load-capable connection between the outer sleeve and the inner sleeve.

In a particularly preferred embodiment of the invention, the arresting element has an annular space into which the outer sleeve is insertable by way of an end portion which faces away from the first contact pin. In the end position of the arresting element, the end portion of the outer sleeve facing away from the first contact pin thus assumes a position in the annular space of the arresting element. In such a configuration, the arresting element extends on the inner side and the outer side of the end portion of the outer sleeve facing away from the first contact pin, as well as on the end-face thereof.

The end portion of the outer sleeve facing away from the first contact pin may preferably be pressed into the annular space.

The arresting element is advantageously made of an electrically nonconductive material.

As mentioned above, the electrical transmission quality of coaxial plug-in connector arrangements may be impaired by unintentional movements of the inner sleeve relative to the outer sleeve. To keep such impairment particularly low, in an advantageous embodiment of the invention, the coaxial plug-in connector arrangement has a spring element, which is clampable in the axial direction between mutually facing support surfaces of the inner sleeve and the outer sleeve. The spring element is compressed in the axial direction when the inner sleeve is inserted into the outer sleeve and thus acts against the retention force of the arresting element, which retention force is oriented in the axial direction. The interaction of the arresting element and the spring element ensures that the extent of unintentional micromotions of the inner sleeve relative to the outer sleeve may be kept particularly low. The spring element acts against axial micromotions of the inner sleeve, and provides tolerance compensation, which balances out manufacturing inaccuracies of the inner sleeve, the outer sleeve, and the arresting element.

It is advantageous when the spring element is clampable between two mutually facing support surfaces of the inner sleeve and the outer sleeve not only in the axial direction but also in the radial direction. This has the advantage that the spring element can act on the inner sleeve and the outer sleeve with an axial spring force as well as with a radial spring force. In this way, possible micromotions of the inner sleeve relative to the outer sleeve can be counteracted in an especially effective manner.

The spring element is advantageously supported on radially oriented steps of the inner sleeve and the outer sleeve. For example, it may be provided that the inner sleeve carries an annular groove, extending in the circumferential direction, in which the spring element is situated, the spring element protruding from the annular groove in the radial direction and abutting against a step of the outer sleeve in the protruding region of the spring element, the inner wall of the outer sleeve expanding at the step in the radial direction.

It may also be provided that the spring element is supported on the one hand on a shoulder of the inner sleeve and on the other hand on a radially oriented step of the outer sleeve.

The spring element preferably surrounds the inner sleeve in the circumferential direction.

It is particularly advantageous when the spring element is formed as a ring-shaped elastomer part. In such an embodiment, the spring element is made of an elastomeric material, which ensures elastic deformation of the spring element by means of a simple design. The elastomer part is formed as a ring, and may assume a position between a support surface of the outer sleeve and a support surface of the inner sleeve when the inner sleeve is inserted into the outer sleeve.

It is particularly advantageous when an annular space, which extends between the inner sleeve and the outer sleeve, is sealable by means of the spring element. In such an embodiment of the invention, the spring element has a sealing function in addition to its resilient function, in that it prevents the penetration of moisture and dirt particles into the annular space which extends between the inner sleeve and the outer sleeve.

In a preferred embodiment of the invention, the spring element is formed as an O-ring or in the form of a sealing sleeve. The sealing sleeve forms a cylindrical sheath, which surrounds the inner sleeve in the circumferential direction and is supported, for example, on a shoulder of the inner sleeve and on a step of the outer sleeve.

The following description of advantageous embodiments of the invention is used to explain the invention in greater detail in conjunction with the drawings.

DETAILED DESCRIPTION OF THE INVENTION

Figure 1:
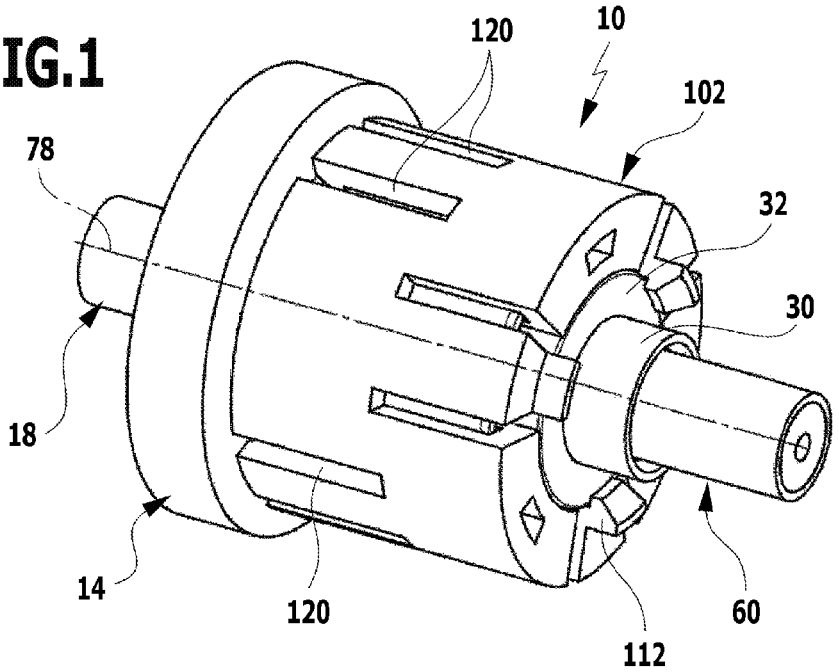
FIG. 1 shows a perspective illustration of a first embodiment of a coaxial plug-in connector arrangement according to the invention.
Figure 2:
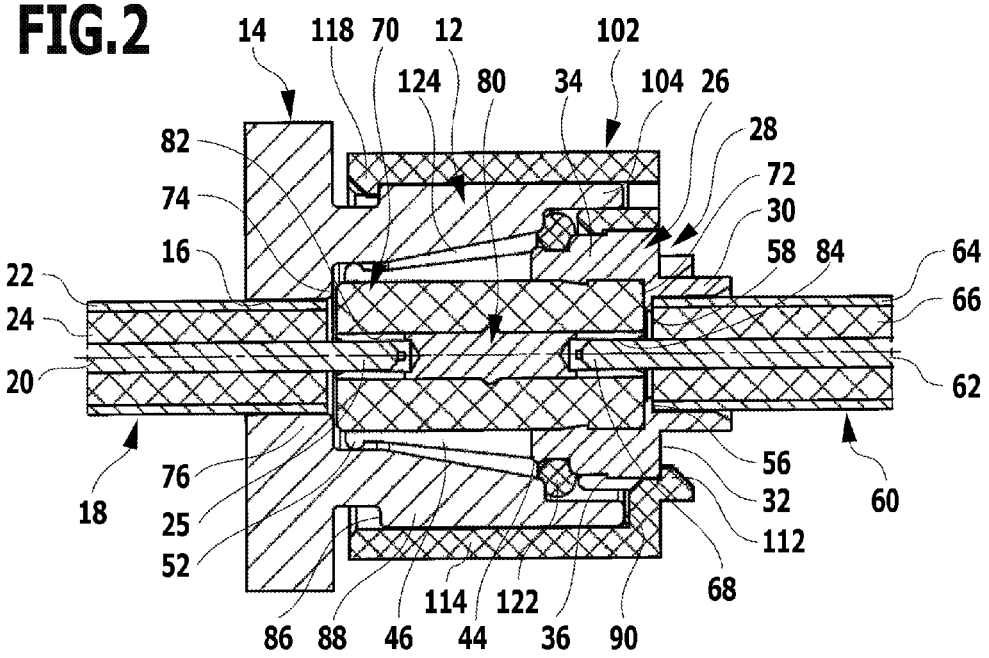
FIG. 2 shows a schematic longitudinal sectional view of the coaxial plug-in connector arrangement from FIG. 1.
Figure 3:
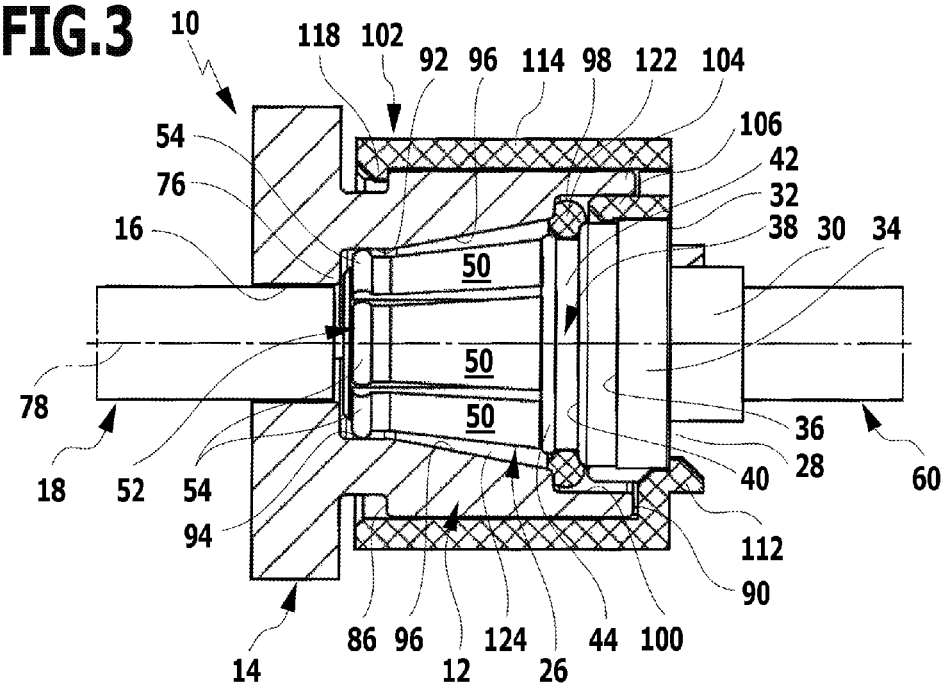
FIG. 3 shows a partial sectional view of the coaxial plug-in connector arrangement from FIG. 1.
Figure 4:
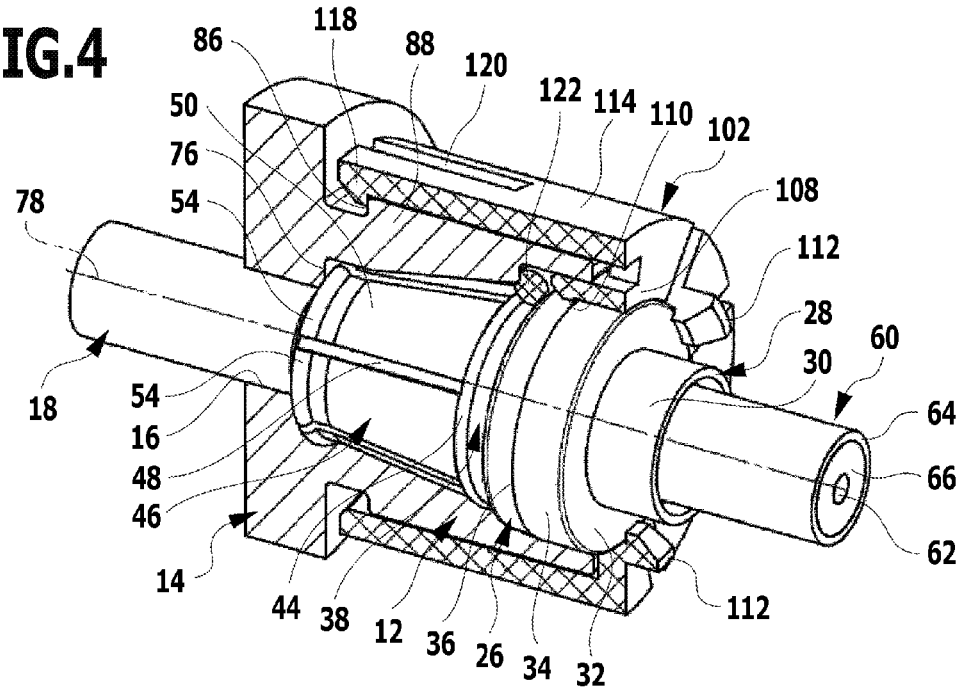
FIG. 4 shows a perspective, partially cutaway illustration of the coaxial plug-in connector arrangement from FIG. 1.

FIGS. 1 to 6 schematically illustrate a first advantageous embodiment of a coaxial plug-in connector arrangement, which is denoted overall by reference numeral 10. The coaxial plug-in connector arrangement 10 includes an outer sleeve 12, which is made of an electrically conductive material, in particular metal, and forms a socket housing 14 having a first through opening 16 into which a first coaxial cable 18 is inserted. The first coaxial cable 18 customarily has an inner conductor 20 and an outer conductor 22, between which a dielectric 24 is situated. The exposed outer conductor 22 is connected in an electrically conductive manner to the outer sleeve 12 in the region of the first through opening 16. In particular, it may be provided that the outer conductor 22 is soldered to the outer sleeve 12. The exposed inner conductor 20 protrudes into the outer sleeve 12 in the axial direction and forms a first contact pin 25.

In addition to the outer sleeve 12, the coaxial plug-in connector arrangement 10 has an inner sleeve 26, which forms a plug housing 28 and which may be inserted into the outer sleeve 12 in the axial direction from the side facing away from the first coaxial cable 18.

On its rear side facing away from the outer sleeve 12, the inner sleeve 26 has a collar-shaped first inner sleeve portion 30, which merges into a second inner sleeve portion 34 via a radially outwardly oriented first step 32. The second inner sleeve portion 34 has a radially inwardly oriented second step 36, and at an axial distance from the second step 36, the second inner sleeve portion 34 has an annular groove 38, which encircles the inner sleeve 26 in the circumferential direction. The annular groove 38 is formed by a radially inwardly oriented third step 40, a groove base 42, which adjoins the third step 40, and an annular bulge 44, which adjoins the groove base 42. The annular bulge 44 of the second inner sleeve portion 34 is adjoined by a third inner sleeve portion 46, which has a plurality of axial slots 48, distributed uniformly over the circumference of the inner sleeve 26, which slots divide the third inner sleeve portion 46 into a multiplicity of first flexible tongues 50. As a result, the third inner sleeve portion 46 is elastically deformable in the radial direction.

At its free end facing away from the second inner sleeve portion 34, the third inner sleeve portion 46 carries a second annular bulge 52, which extends over the circumference of the inner sleeve 26 and is divided by the axial slots 48 into individual annular bulge portions 54.

The inner sleeve 26 has a radially inwardly facing inner shoulder 56, axially offset with respect to the first step 32 in the direction facing away from the first inner sleeve portion 30, which surrounds, in the circumferential direction, a second through opening 58.

A second coaxial cable 60 may be inserted into the collar-shaped first inner sleeve portion 30 in the axial direction. The second coaxial cable 60 customarily has an inner conductor 62, an outer conductor 64, and a dielectric 66 situated between the inner conductor 62 and the outer conductor 64. The exposed outer conductor 64 may be connected in an electrically conductive manner to the first inner sleeve portion 30. In particular, it may be provided that the outer conductor 64 is soldered to the first inner sleeve portion 30. An exposed end region of the inner conductor 62 protrudes into the inner sleeve 26 in the axial direction and forms a second contact pin 68.

The inner sleeve 26 surrounds, with its second inner sleeve portion 34 and its third inner sleeve portion 46, an insulating part 70, which abuts against the inner shoulder 56 with a rear stop surface 72, which surface faces toward the first inner sleeve portion 30, the insulating part also abutting against a bottom wall 76 of the outer sleeve 12, which sleeve has the first through opening 16, with a stop surface 74, which surface protrudes beyond the free end of the inner sleeve 26, i.e., beyond the second annular bulge 52. The insulating part 70 has a through hole, aligned coaxially with the longitudinal axis 78 of the coaxial plug-in connector arrangement 10, in which an electrically conductive inner conductor part 80 is situated. The inner conductor part 80 has a first blind hole-like recess 82 facing the first coaxial cable 18, and the inner conductor part 80 has a second blind hole-like recess 84 facing the second coaxial cable 60. The second contact pin 68 protrudes into the second recess 84 and may be electrically connected to the inner conductor part 80; in particular it may be provided that the second contact pin 68 is soldered to the inner conductor part 80 in the region of the second recess 84. For this purpose, a solder deposit, not illustrated in the drawing, may be situated in the second recess 84.

When the inner sleeve 26 is inserted far enough into the outer sleeve 12 for the front stop surface 74 of the insulating part 70 to abut against the bottom wall 76 of the outer sleeve 12, the first contact pin 25 protrudes into the first recess 82, an electrically conductive connection being established between the first contact pin 25 and the inner conductor part 80. The first contact pin 25 may be connected in an electrically conductive manner to the second contact pin 68 via the inner conductor part 80. At the same time, the outer conductor 22 of the first coaxial cable 18 may be connected in an electrically conductive manner to the inner sleeve 26 via the electrically conductive outer sleeve 12 and the second annular bulge 52, the first inner sleeve portion 30 of the inner sleeve in turn being connected in an electrically conductive manner to the outer conductor 64 of the second coaxial cable 60.

On its outer side, at a distance from the bottom wall 76, the outer sleeve 12 has a radially outwardly oriented fourth step 86 that is adjoined by a cylindrical circumferential wall 88, which extends up to an end face 90 of the outer sleeve 12 facing away from the bottom wall 76.

The inner side of the outer sleeve 12 is adjoined at the bottom wall 76 by a first circular cylindrical wall portion 92, which forms a contact area 94 for the second annular bulge 52 of the inner sleeve 26. The contact area 94 surrounds the second annular bulge 52 in the circumferential direction. The outer sleeve 12 is connected in an electrically conductive manner to the inner sleeve 26 only via the contact area 94 and the second annular bulge 52.

A conical wall portion 96 of the outer sleeve 12 adjoins the first circular cylindrical wall portion 92. The internal diameter of the outer sleeve 12 continuously increases in the region of the conical wall portion 96. The conical wall portion 96 is adjoined by a radially outwardly oriented fifth step 98 via which the internal diameter of the outer sleeve 12 increases. A second circular cylindrical wall portion 100 of the outer sleeve 12 adjoins the fifth step 98. The second circular cylindrical wall portion 100 extends up to the end face 90 of the outer sleeve 12.

In addition to the outer sleeve 12 and the inner sleeve 26, the coaxial plug-in connector arrangement 10 has an arresting element 102, which fixes the inner sleeve 26 in the outer sleeve 12. The arresting element 102 is made of an electrically nonconductive material. In particular, it may be provided that the arresting element 102 is made of the same electrically nonconductive material as the insulating part 70. A polytetrafluoroethylene material, for example, may be used for manufacturing the arresting element 102.

Figure 6:
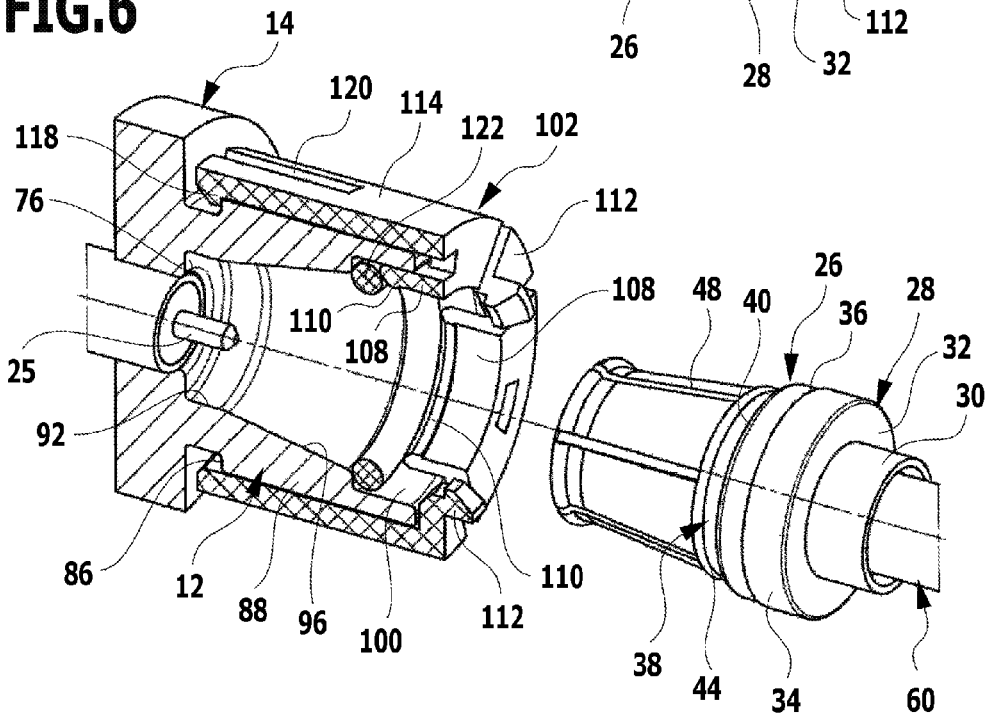
FIG. 6 shows a perspective, partially cutaway illustration of the coaxial plug-in connector arrangement from FIG. 1, the arresting element being premounted on the outer sleeve before the inner sleeve is inserted into the outer sleeve.

The arresting element 102 is formed as a sleeve, which with respect to the longitudinal axis 78 of the coaxial plug-in connector arrangement 10 has a double-walled configuration substantially in line with an end portion 104 of the outer sleeve 12 adjacent to the end face 90. In line with the end portion 104, the arresting element 102 has an arresting collar 106, which is formed by a plurality of pressing wings uniformly distributed over the circumference of the inner sleeve 26, of which one pressing wing 108 is illustrated in FIG. 6. The pressing wings 108 are formed as flexible tongues, and at their free end in each case carry a radially inwardly oriented detent projection 110, which engages behind the second step 36 of the second inner sleeve portion 34. The pressing wings 108 may be pressed in between the end portion 104 of the outer sleeve 12 and the second inner sleeve portion 34 of the inner sleeve 26.

Between each two adjacent pressing wings 108, the arresting element 102 has a detent wing 112, which faces away from the end face 90 of the outer sleeve 12 and engages behind the first step 32, via which step the first inner sleeve portion 30 merges into the second inner sleeve portion 34. The detent wings 112 are likewise formed as flexible tongues.

The arresting collar 106 is surrounded by a shell 114 of the arresting element 102. The shell 114 in combination with the arresting collar 106 defines an annular space 116 into which there protrudes the end portion 104 of the outer sleeve 12 that faces away from the first contact pin 25. The shell 114 extends as far as the region of the radially outwardly facing fourth step 86 of the outer sleeve 12, the shell engaging behind the fourth step 86 by means of locking tabs 118. The locking tabs 118 are likewise formed as flexible tongues. The locking tabs 118 are distributed over the circumference of the inner sleeve 26, and in each case are separated from one another by longitudinal slots 120 in the shell 114. The longitudinal slots 120 extend in the axial direction up to a central region of the shell 114 in the longitudinal direction. The arresting element 102 is elastically deformable in the radial direction due to the use of the locking tabs 118 and the use of the pressing wings 108 and the detent wings 112.

The arresting element 102 may be selectively premounted on the inner sleeve 26 or on the outer sleeve 12. This is explained in greater detail below with reference to FIGS. 5 and 6. The arresting element 102 may subsequently be pushed onto the outer sleeve 12 or onto the inner sleeve 26 during insertion of the inner sleeve 26 into the outer sleeve 12. In its end position, the arresting element 102 may be locked to the inner sleeve 26 and also to the outer sleeve 12, the end portion 104 may be pressed into the annular space 116, and the pressing wings 108 may be pressed in between the inner sleeve 26 and the outer sleeve 12, so that by means of the arresting element 102, a load-capable and detachable mechanical connection between the inner sleeve 26 and the outer sleeve 12 may be achieved for fixing the inner sleeve 26 relative to the outer sleeve 12.

To counteract manufacturing tolerances of the outer sleeve 12, the inner sleeve 26, and the arresting element 102, which could result in the inner sleeve 26 being able to still undergo micromotions relative to the outer sleeve 12 despite the use of the arresting element 102, the coaxial plug-in connector arrangement 10 has a spring element, in the form of an O-ring 122, which is situated in the annular groove 38 and which protrudes from the annular groove 38 in the radial direction. The O-ring 122 is made of an elastomeric material, and is supported on the one hand on the third step 40 of the inner sleeve 26, which borders the annular groove 38, and on the other hand on the fifth step 98 of the outer sleeve 12, situated between the conical wall portion 26 and the second circular cylindrical wall portion 100. The O-ring 122 is elastically deformable, and is compressed in the axial direction when the arresting element 102 is in its end position.

Micromotions of the inner sleeve 26 relative to the outer sleeve 12 may be kept very small by means of the O-ring 122. In addition, the O-ring 122 forms a sealing element via which the penetration of moisture into the outer sleeve 12 as well as the penetration of dirt particles may be prevented. An annular space 124 extending between the third inner sleeve portion 46 and the conical wall portion 96 may be sealed tight against splashing water and dust by means of the O-ring 122.

Figure 5:
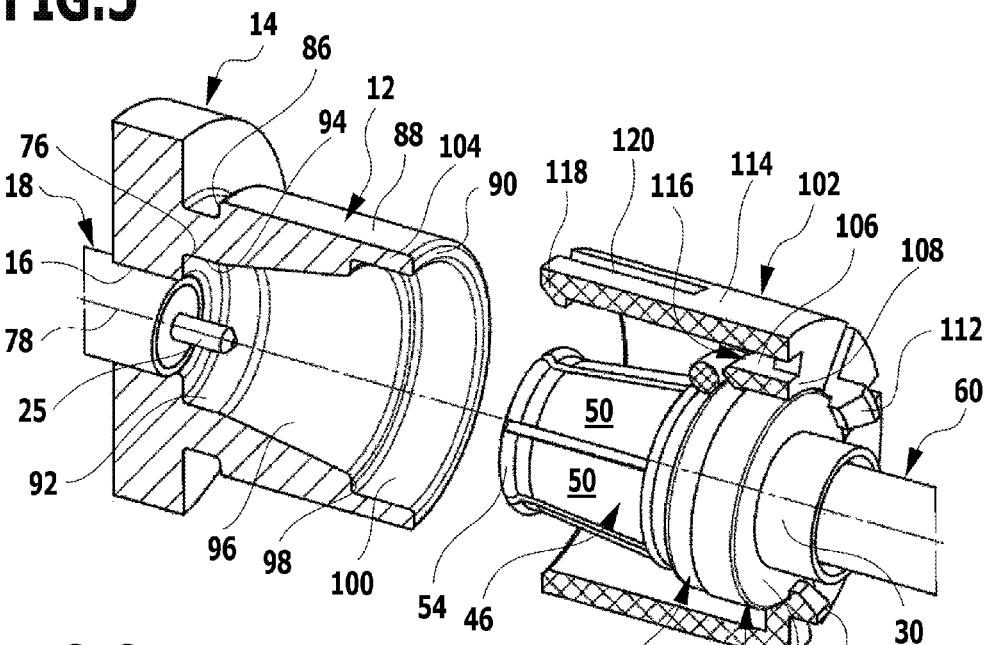
FIG. 5 shows a perspective, partially cutaway illustration of the coaxial plug-in connector arrangement from FIG. 1, an arresting element being premounted on an inner sleeve before the inner sleeve is inserted into an outer sleeve.

As mentioned above, the arresting element 102 may be selectively premounted by the user on the inner sleeve 26 or on the outer sleeve 12. FIG. 5 illustrates a situation in which the arresting element 102, in a first stage, has been pushed and pressed far enough onto the inner sleeve 26 that the detent wings 112 on the rear side engage behind the first step 32, and the pressing wings 108 engage behind the second step 36, so that the arresting element 102 is locked to the inner sleeve 26 for the premounting and is held on the inner sleeve 26 so as to be axially immovable and non-rotatable.

The O-ring 122 is inserted into the annular groove 38 in a further stage of the mounting. The premounted assembly in the form of the inner sleeve 26, the arresting element 102, and the O-ring 122 may then be connected to the outer sleeve 12. The inner sleeve 26 is, in so doing, inserted far enough into the outer sleeve 12 for the front stop surface 74 to come to abut against the bottom wall 76 and the second annular bulge 52 to engage on the contact area 94. At the same time, the arresting element 102 is pushed and pressed far enough onto the outer sleeve 12 in the axial direction for the locking tabs 118 to engage behind the fourth step 86 of the outer sleeve 12. The inner sleeve 26 is thus acted on by the arresting element 102 with a force in the direction of the outer sleeve 12, so that the O-ring 122 is slightly elastically deformed, and the insulating part 60 is clamped between the bottom wall 76 of the outer sleeve 12 and the inner shoulder 56 of the inner sleeve 26.

Alternatively, the user has the option of fixing the arresting element 102 on the outer sleeve 12 for the premounting. This is illustrated in FIG. 6. The arresting element 102 may be pushed and pressed by the user far enough onto the outer sleeve 12 in the axial direction for the locking tabs 118 to engage behind the fourth step 86 and the end portion 104 to protrude into the annular space 116. The arresting element 102, which is premounted on the outer sleeve 12, may subsequently be pushed and pressed far enough onto the inner sleeve 26, when the inner sleeve 26 is inserted into the outer sleeve 12, for the detent wings 112 to engage behind the inner sleeve 26 on the first step 32 and the pressing wings 108 to be pressed in between the end portion 104 of the outer sleeve 12 and the second inner sleeve portion 34 and to engage behind the inner sleeve 26 at the second step 36. A detent connection which is non-rotatable and axially immovable is thus achieved between the arresting element 102 and the inner sleeve 26 when the inner sleeve 26 is inserted into the outer sleeve 12, so that the inner sleeve 26 is fixed in the outer sleeve 12 by means of the arresting element 102.

Figure 7:
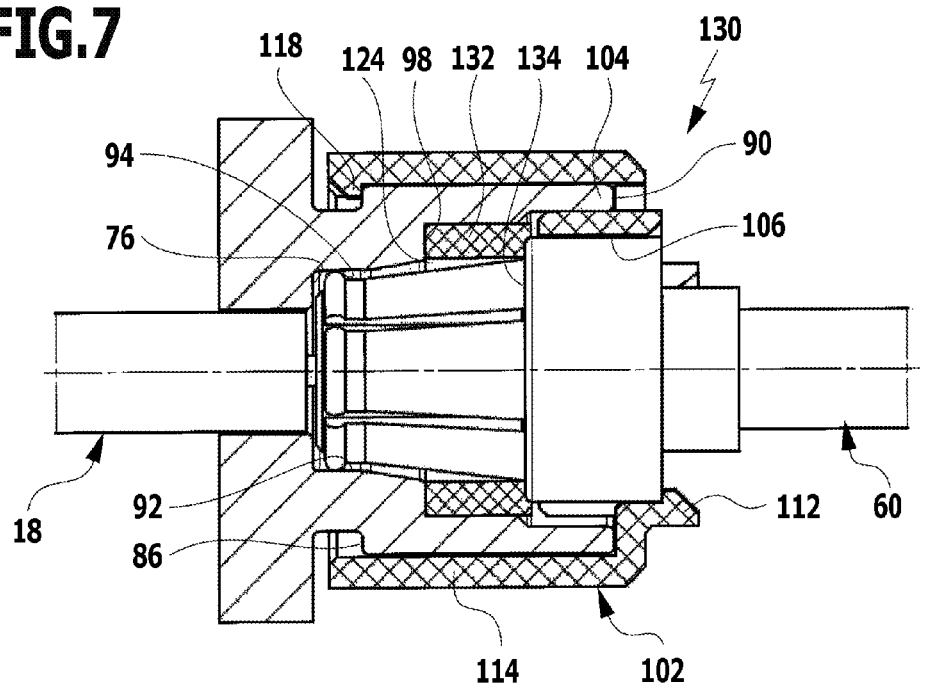
FIG. 7 shows a partial sectional view of a second embodiment of a coaxial plug-in connector arrangement according to the invention.
Figure 8:
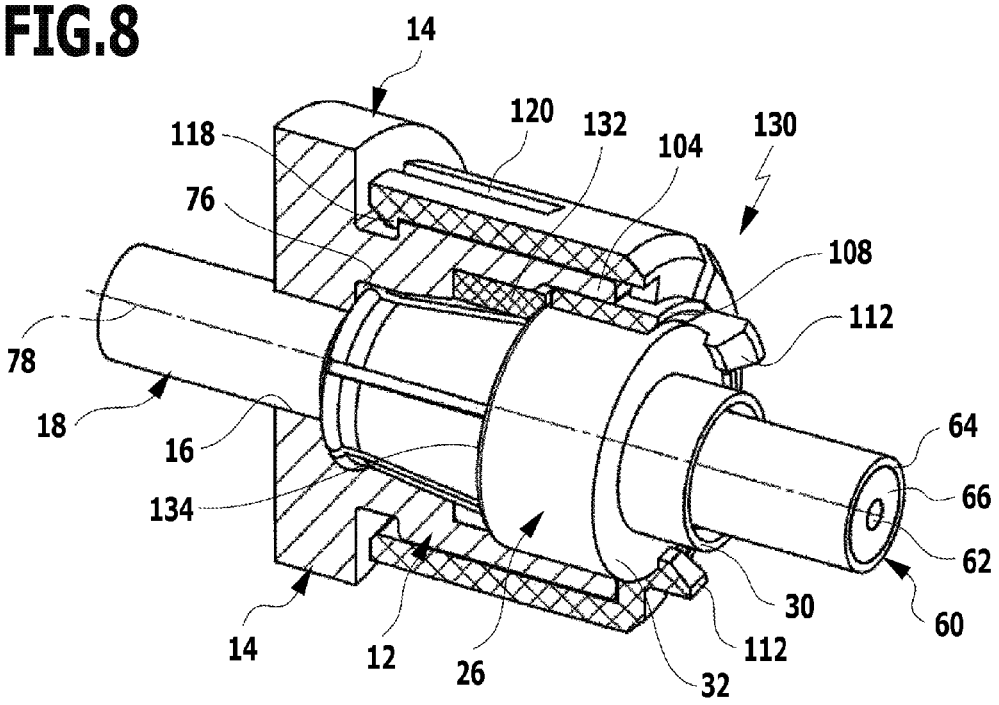
FIG. 8 shows a perspective, partially cutaway illustration of the coaxial plug-in connector arrangement from FIG. 7.

FIGS. 7 and 8 illustrate a second advantageous embodiment of a coaxial plug-in connector arrangement according to the invention, denoted overall by reference numeral 130. The coaxial plug-in connector arrangement 130 is substantially identical to the coaxial plug-in connector arrangement 10 described above with reference to FIGS. 1 to 6. Therefore, for identical components, the same reference numerals are used in FIGS. 7 and 8 as for FIGS. 1 to 6, and with regard to these components, reference is made to the above explanations in order to avoid repetitions.

The coaxial plug-in connector arrangement 130 differs from the coaxial plug-in connector arrangement 10 in that the second inner sleeve portion 34 has a constant external diameter over its entire length with respect to the longitudinal axis 78. Thus, the second step 36 is dispensed with in the coaxial plug-in connector arrangement 130. Accordingly, the arresting collar 106 of the arresting element 102 of the coaxial plug-in connector arrangement 130 has no detent projections 110. In the coaxial plug-in connector arrangement 130, the arresting collar 106 is radially expanded, i.e.; the arresting collar 106 is pressed onto the second inner sleeve portion 34, when the arresting element 102 is pushed onto the second inner sleeve portion 34. Upon pressing on the second inner sleeve portion 34, the arresting element 102 reaches its end position as a result of the detent wings 112 engaging behind the first step 32, as explained above in the example of the coaxial plug-in connector arrangement 10.

Another difference between the coaxial plug-in connector arrangement 130 and the coaxial plug-in connector arrangement 10 lies in the configuration of the spring element. While an O-ring 122 is used in the coaxial plug-in connector arrangement 10, in the coaxial plug-in connector arrangement 130, a sealing sleeve 132 is used, which is made of an elastomeric material, and is supported on the one hand on an annular shoulder 134 of the inner sleeve 26 and on the other hand on a fifth step 98 of the outer sleeve 12. The sealing sleeve 132 forms a spring element and sealing element, similar to the O-ring 122 explained in detail above, which counteracts any micromotions of the inner sleeve 26 and also prevents the penetration of moisture and dirt particles into the outer sleeve 12.

Also in the coaxial plug-in connector arrangement 130, the user has the option of selectively premounting the arresting element 102 on the inner sleeve 26 or on the outer sleeve 12. If the arresting element 102 is initially pushed onto the second inner sleeve portion 34 of the inner sleeve 26, with the arresting element 102 expanded in the radial direction, when, thereafter, the inner sleeve 26 is inserted into the outer sleeve 12, the arresting element 102 may subsequently be pushed onto the outer sleeve 12 until the locking tabs 118 engage behind the fourth step 86 of the outer sleeve 12. However, for the premounting, the user also has the option of initially pushing the arresting element 102 onto the outer sleeve 12, and when the inner sleeve 26 is inserted into the outer sleeve 12, the arresting element 102 may subsequently be pushed onto the second inner sleeve portion 34 of the inner sleeve 26 until the detent wings 112 of the arresting element 102 engage behind the first step 32 of the inner sleeve 26.

Also in the coaxial plug-in connector arrangement 130 schematically illustrated in FIGS. 7 and 8, the inner sleeve 26 is fixed in the outer sleeve 12 by means of the arresting element 102, and any micromotions of the inner sleeve 26 are counteracted by use of the sealing sleeve 132.

Figure 9:
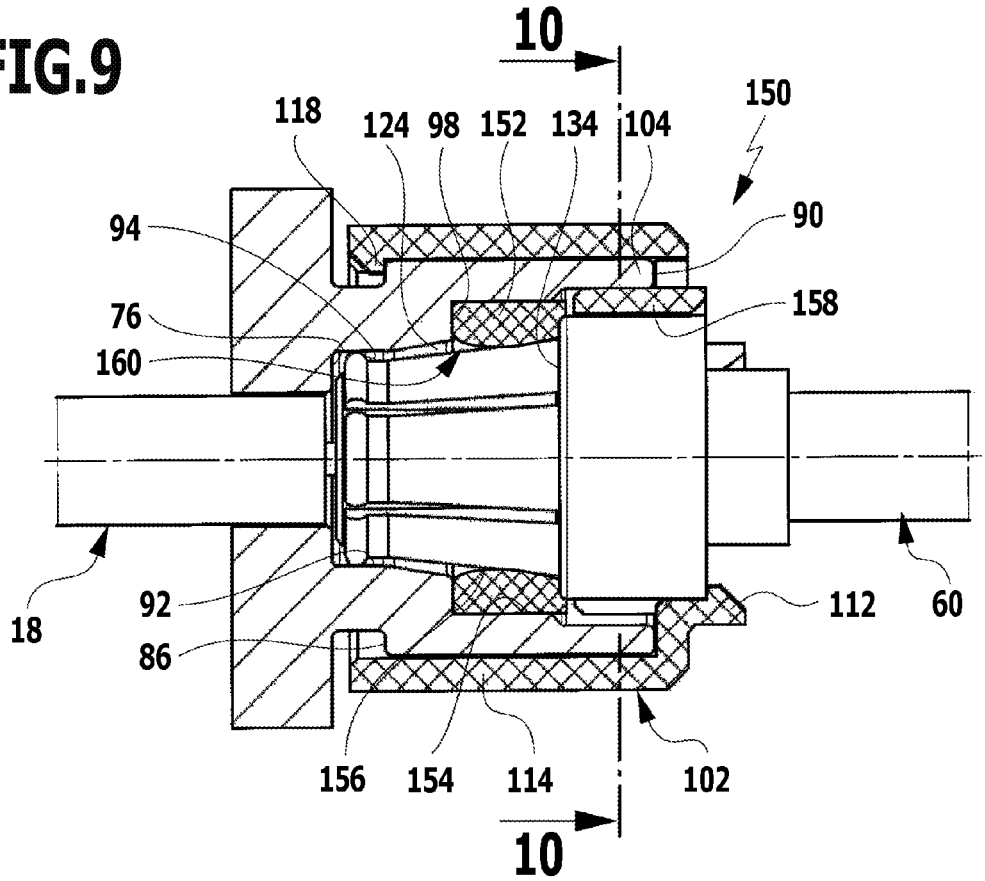
FIG. 9 shows a partial sectional view of a third embodiment of a coaxial plug-in connector arrangement according to the invention.
Figure 10:
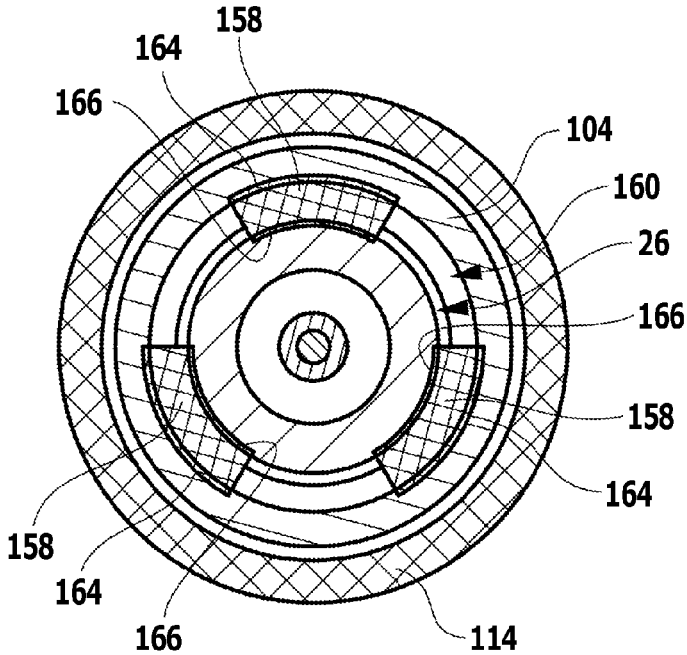
FIG. 10 shows a sectional view of the coaxial plug-in connector arrangement along the line 10-10 in FIG. 9, pressing wings of the arresting element being shown oversized for clarity.

FIGS. 9 and 10 schematically illustrate a third advantageous embodiment of a coaxial plug-in connector arrangement, which is denoted overall by reference numeral 150. The coaxial plug-in connector arrangement 150 is substantially identical to the coaxial plug-in connector arrangement 130 described above with reference to FIGS. 7 and 8. Therefore, for identical components, the same reference numerals are used in FIGS. 8 and 9 as for FIGS. 7 and 8, and with regard to these components, reference is made to the above explanations in order to avoid repetitions.

The coaxial plug-in connector arrangement 150 differs from the coaxial plug-in connector arrangement 130 in that instead of the sealing sleeve 132, which is clamped only in the axial direction between two facing support surfaces of the inner sleeve 26 and the outer sleeve 12, a sealing sleeve 152 is used which is clamped both in the axial direction and also in the radial direction between mutually facing support surfaces of the inner sleeve 26 and the outer sleeve 12. In the axial direction, the sealing sleeve 152 is clamped in similar manner to the sealing sleeve 132 in the embodiment illustrated in FIGS. 7 and 8, between the fifth step 98 of the outer sleeve 12 and the annular shoulder 134 of the inner sleeve 26, and in the radial direction the sealing sleeve 152 is clamped between a cylindrical wall portion 154 of the outer sleeve 12 that adjoins the fifth step 98 in the direction of the end face 90 and a conical wall portion 156 of the inner sleeve 26 that adjoins the annular shoulder 134 in the direction of the annular bulge 54. The conical wall portion 156 is here formed by the flexible tongues 50 of the inner sleeve 26. The sealing sleeve 152 forms a spring element that counteracts possible micromotions of the inner sleeve 26 relative to the outer sleeve 12 and moreover effects reliable sealing so that moisture and particles of dirt cannot penetrate into the annular space 124 and thus not into the contact area either in which the annular bulge 52 engages on the circular cylindrical wall portion 94 of the outer sleeve 12.

The coaxial plug-in connector arrangement 150 schematically illustrated in FIGS. 9 and 10 further differs from the coaxial plug-in connector arrangement 130 schematically illustrated in FIGS. 7 and 8 in that the arresting element 102 has three pressing wings 158 distributed uniformly over the circumference of the arresting element 102, which have, before insertion of the inner sleeve 26 into the outer sleeve 12, a radial extent which is greater than the extent of the accommodating space 160 that extends between the end portion 104 of the outer sleeve 12 and the second inner sleeve portion 34 and into which the pressing wings 158 may be pressed. The pressing wings 158 have an oversize dimension which is shown in FIG. 10 and, in the schematically illustrated embodiment shown in FIGS. 9 and 10, extends over the entire outer side 164 and over the entire inner side 166 of the pressing wing 158. After insertion of the inner sleeve 26 into the outer sleeve 12, the outer sides 164 of the pressing wings 158 thus engage in face-to-face manner on the inner side of the end portion 104 of the outer sleeve 12, and, after insertion of the inner sleeve 26 into the outer sleeve 12, the inner sides 166 of the pressing wings 158 engage in face-to-face manner on the outer side of the inner sleeve portion 34. The pressing wings 158 are here compressed in a plastic manner, or preferably in an elastic manner, and exert thereby a substantial holding force on the inner sleeve 26 and the outer sleeve 12, so that the inner sleeve 26 can undergo practically no micromotions whatever relative to the outer sleeve 12.

Also in the coaxial plug-in connector arrangement 150, the user has the option of selectively premounting the arresting element 102 on the inner sleeve 26 or on the outer sleeve 12. In this regard, reference is made to the above explanations of the coaxial plug-in connector arrangement 130 in order to avoid repetitions.

Figure 11:
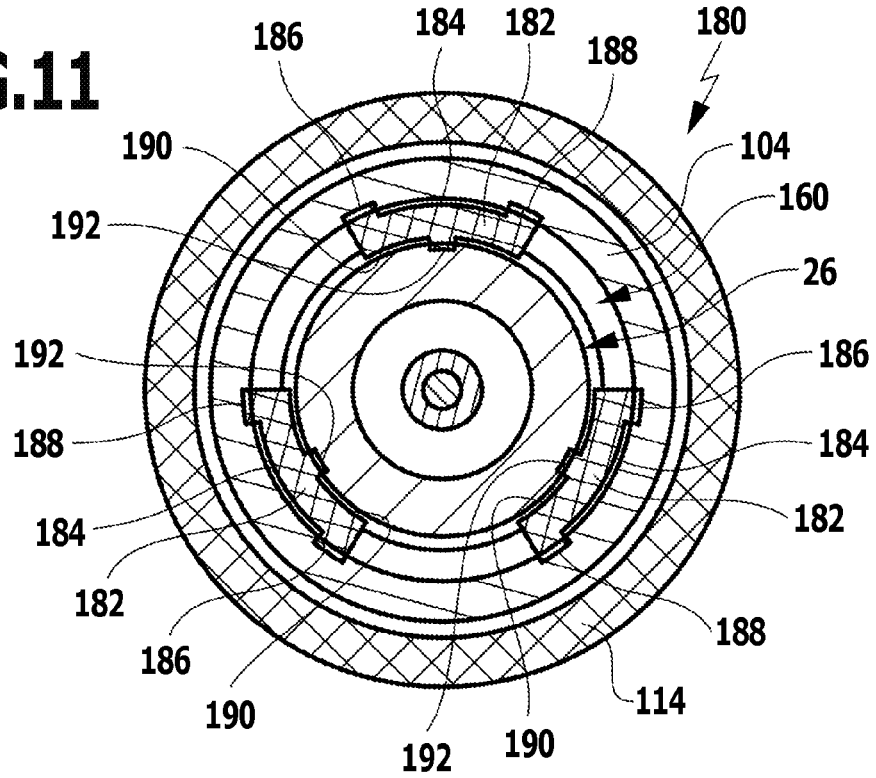
FIG. 11 shows a sectional view, corresponding to FIG. 10, of a fourth embodiment of a coaxial plug-in connector arrangement according to the invention, wherein, for clarity, radial elevations of the pressing wings are shown oversized.
Figure 12:
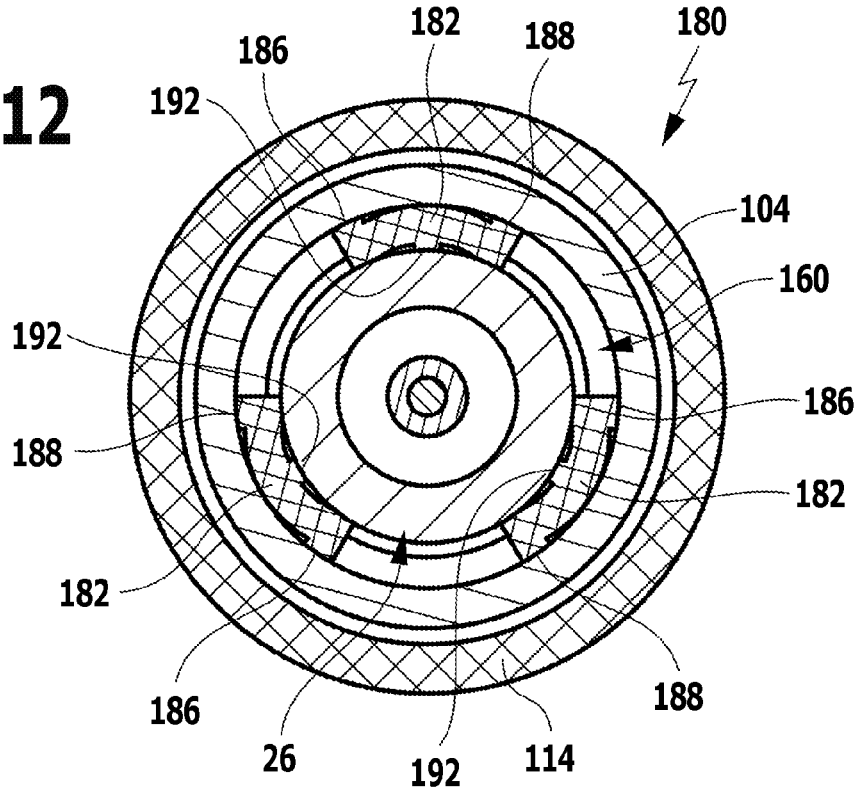
FIG. 12 shows a sectional view corresponding to FIG. 11, the pressing wings with the radial elevations being shown after pressing-in into an accommodating space.

FIGS. 11 and 12 schematically illustrate a fourth advantageous embodiment of a coaxial plug-in connector arrangement, which is denoted overall by reference numeral 180. The coaxial plug-in connector arrangement 180 is substantially identical to the coaxial plug-in connector arrangement 150 described above with reference to FIGS. 9 and 10. Therefore, for identical components, the same reference numerals are used in FIGS. 11 and 12 as for FIGS. 9 and 10, and with regard to these components, reference is made to the above explanations in order to avoid repetitions.

The coaxial plug-in connector arrangement 180 differs from the coaxial plug-in connector arrangement 150 in that pressing wings 182 are used that have an oversize dimension only in the region of radially oriented elevations. To this end, the pressing wings 182 have on their outer side 184 two outer elevations 186, 188 that are arranged spaced apart from one another and facing radially outwards, and the pressing wings 182 have, on their inner side 190, in each case one inner elevation 192 that is directed radially inwards. Relative to the circumferential direction of the arresting element 102, the inner elevation 192 of each pressing wing 182 is located centrally between the outer elevations 186 and 188. In the region between the outer and inner elevations 186, 188 and 192, the pressing wings 182 of the coaxial plug-in connector arrangement 180 have no oversize dimension, rather, in the region between the outer and inner elevations 186 and 188 and the inner elevation 192, the radial extent of the pressing wings 182 is at most the same as the radial extent of the accommodating space 160 into which the pressing wings 182 can be pressed. In the region of the outer elevations 186, 188 and in the region of the inner elevation 192, the radial extent of the pressing wings 182 is however, before pressing into the accommodating space 160, greater than the radial extent of the accommodating space 160, so that the pressing wing 182, in the region of the outer elevations 186, 188 and the inner elevation 192, is compressed during insertion into the accommodating space 160. Moreover, the pressing wings 182 are bent during insertion into the accommodating space 160 in the region between the outer elevations 186, 188 and the inner elevation 192. This is especially clear from FIG. 12. The oversize dimension that is present only in the region of the outer and inner elevations 186, 188 and 192 facilitates the pressing of the pressing wings 182 into the accommodating space 160, and the bending of the pressing wings 182 in the region between the outer elevations 186, 188 and the inner elevation 192 ensures, in combination with the compression of the elevations 186, 188 and 192, reliable fixing of the inner sleeve 26 in the outer sleeve 12.

Figure 13:
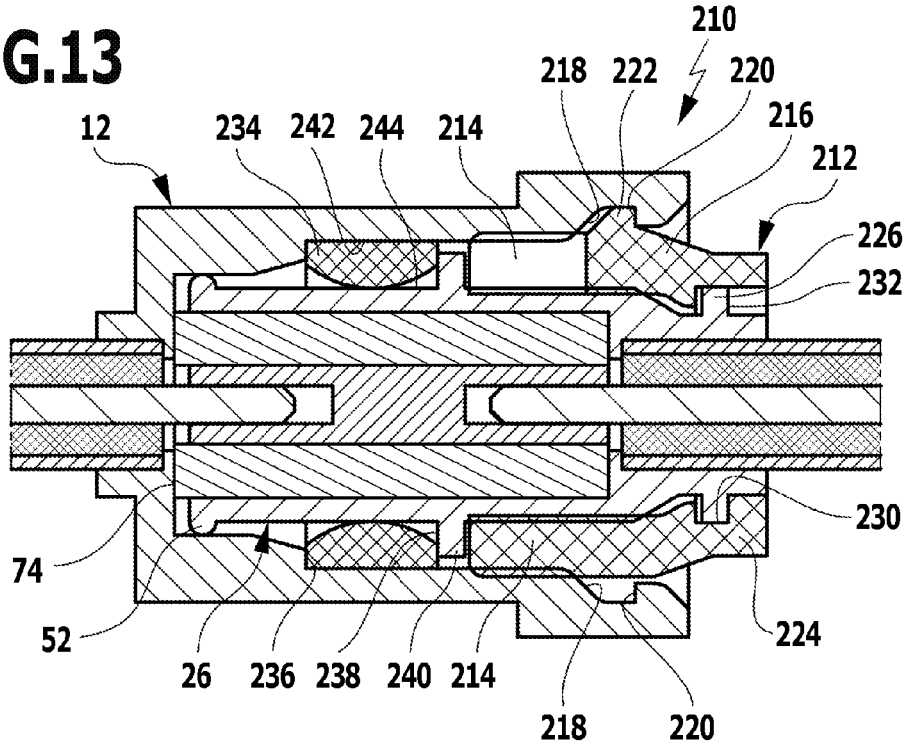
FIG. 13 shows a schematic longitudinal sectional view of a fifth embodiment of a coaxial plug-in connector arrangement according to the invention.
Figure 14:
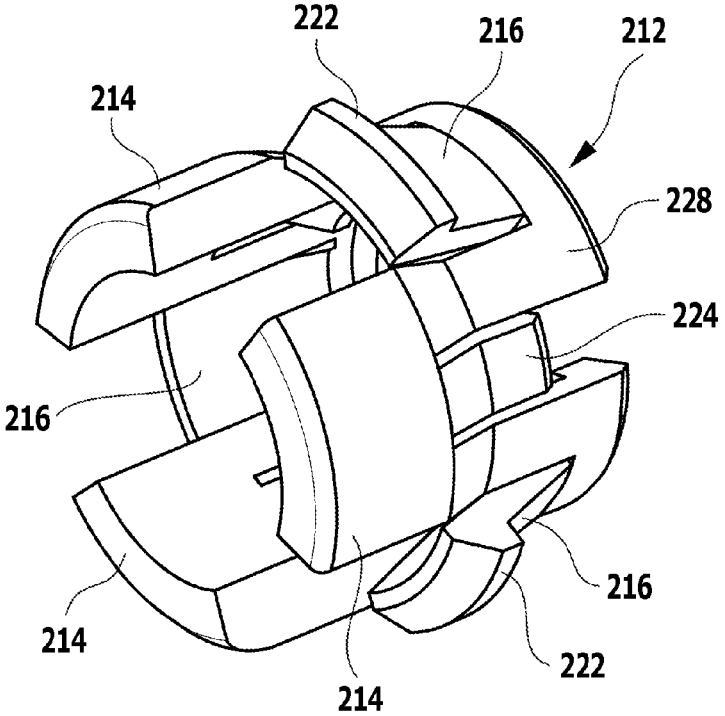
FIG. 14 shows a perspective illustration of an arresting element of the coaxial plug-in connector arrangement of FIG. 13.

FIGS. 13 and 14 schematically illustrate a fifth advantageous embodiment of a coaxial plug-in connector arrangement, which is denoted overall by reference numeral 210. The coaxial plug-in connector arrangement 210 is substantially identical to the coaxial plug-in connector arrangement 150 described above with reference to FIGS. 9 and 10. Therefore, for identical components, the same reference numerals are used in FIGS. 13 and 14 as for FIGS. 9 and 10, and with regard to these components, reference is made to the above explanations in order to avoid repetitions.

The coaxial plug-in connector arrangement 210 differs from the coaxial plug-in connector arrangement 150 by an arresting element 212, which, in contrast to the previously described arresting element 102, has no shell, which surrounds the outer sleeve in the circumferential direction. The arresting element 212 has instead three pressing wings 214 which are arranged in the circumferential direction at a uniform spacing from one another, which, in corresponding manner as for the pressing wings 158 explained above with reference to FIGS. 9 and 10, can be pressed in between the inner sleeve 26 and the outer sleeve 12 and thus have an oversize dimension prior to pressing-in. In addition, the arresting element 212 has three first detent wings 216, which interact with locking elements in the form of a locking groove 218 formed into the end portion 104 of the outer sleeve 12 on the inner side, in order to achieve a locking connection. The locking groove 218 has a groove wall 220 which is oriented perpendicular to the longitudinal axis 78 of the coaxial plug-in connector arrangement 210, forms a retaining surface, and can be engaged from the rear by a detent hook 222 of the detent wing 216. The pressing wings 214 and the first detent wings 216 alternate in the circumferential direction of the arresting element 212, so that in each case a detent wing 216 follows a pressing wing 214. This will be especially clear from FIG. 14. By means of the first detent wings 216, a locking connection can therefore be established between the arresting element 212 and the outer sleeve 12 of the coaxial plug-in connector arrangement 210. In addition, a locking connection can also be established between the arresting element 212 and the inner sleeve 26 of the coaxial plug-in connector arrangement 210. To this end, the arresting element 212 has three second detent wings 224 that are distributed uniformly over the circumference of the arresting element 212 and interact with a locking element of the inner sleeve 26 in the sense of a locking connection. The locking element forms a first annular collar 226, which extends over the periphery of the inner sleeve 26 in an end region 228 facing away from the outer sleeve 12. The second detent wings 224 provide in each case a locking recess 230, which accommodate the first annular collar 226, the second detent wings 224 engaging behind a rear side 232 of the first annular collar 226 that faces away from the outer sleeve 12. The rear side 232 thus forms, in the same way as the groove wall 220 of the locking groove 218, a retaining surface that is oriented perpendicularly to the longitudinal axis 78 of the coaxial plug-in connector arrangement 210 and behind which the arresting element 212 engages.

The coaxial plug-in connector arrangement 210 is thus distinguished by a particularly compact structure, the arresting element 212 engaging behind the outer sleeve 12 on the inner side and the inner sleeve 26 on the outer side, and thereby acting on the inner sleeve 26 with a force in the direction of the outer sleeve 12. In addition, possible micromotions of the inner sleeve 26 are counteracted by the pressing wings 214.

In corresponding manner as for the coaxial plug-in connector arrangement 150 described above with reference to FIGS. 9 and 10, a sealing sleeve 234 is also used in the case of the coaxial plug-in connector arrangement 210, which is clamped both in the radial direction and also in the axial direction between the inner sleeve 26 and the outer sleeve 12. The sealing sleeve 234 is here clamped in the axial direction on the one hand on a step 236 on the inner side of the outer sleeve 12 of the coaxial plug-in connector arrangement 210 and on the other hand an end face 238 of a second annular collar 240 situated at a spacing from the first annular collar 226. The sealing sleeve 234 is clamped in the radial direction between a circular cylindrical wall portion 242 of the outer sleeve 12 and a wall portion 244 of the inner sleeve 26 of the coaxial plug-in connector arrangement 210 that adjoins the second annular collar 240 in the direction of the second annular bulge 52. The sealing sleeve 234 likewise counteracts possible micromotions of the inner sleeve 26 and prevents in addition penetration of moisture and dirt particles into the region in which the annular bulge 52 of the inner sleeve 26 engages on the first circular cylindrical wall portion 92 of the outer sleeve 12.

The invention claimed is:

1. Coaxial plug-in connector arrangement, comprising:

an electrically conductive outer sleeve, an electrically conductive inner sleeve which is insertable into the outer sleeve in an axial direction and is electrically connectable to the outer sleeve, a first contact pin being insertable into the outer sleeve from a side of the outer sleeve which faces away from the inner sleeve, a second contact pin being insertable into the inner sleeve from a side of the inner sleeve which faces away from the outer sleeve, an insulating part in which an inner conductor part is mounted, the insulating part being located in the inner sleeve, the first and the second contact pins being connectable to one another in an electrically conductive manner via the inner conductor part, and an arresting element which is mountable on one of the inner sleeve or the outer sleeve before insertion of the inner sleeve into the outer sleeve, the arresting element being pushed onto the outer sleeve or being engaged with the inner sleeve during or after insertion of the inner sleeve into the outer sleeve, the inner sleeve being detachably fixable in the outer sleeve by means of the arresting element, wherein the inner sleeve in an inserted state electrically contacts the outer sleeve only in at least one contact area of the outer sleeve which extends in a circumferential direction of the inner sleeve, and the inner sleeve is acted on by the arresting element with an axial tensile force in a direction of the outer sleeve, a stop surface of the insulating part abutting against the outer sleeve, the stop surface protruding beyond a free end of the inner sleeve in the axial direction.

2. Coaxial plug-in connector arrangement according to claim 1, wherein the arresting element is adapted to be selectively mounted on one of the inner sleeve or the outer sleeve before the inner sleeve is inserted into the outer sleeve.

3. Coaxial plug-in connector arrangement according to claim 1, wherein the arresting element is adapted to be selectively pushed onto one of the inner sleeve or the outer sleeve before the inner sleeve is inserted into the outer sleeve.

4. Coaxial plug-in connector arrangement according to claim 1, wherein the arresting element surrounds at least one of the inner sleeve or the outer sleeve in the circumferential direction after the inner sleeve is inserted into the outer sleeve.

5. Coaxial plug-in connector arrangement according to claim 1, wherein the arresting element surrounds at least one of the inner sleeve and the outer sleeve in an electrically insulating manner.

6. Coaxial plug-in connector arrangement according to claim 1, wherein the arresting element is detachably lockable to at least one of the inner sleeve and the outer sleeve.

7. Coaxial plug-in connector arrangement according to claim 1, wherein the arresting element is at least one of elastically and plastically deformable in a radial direction.

8. Coaxial plug-in connector arrangement according to claim 1, wherein the arresting element is adapted to be pressed onto at least one of the inner sleeve and the outer sleeve, or is adapted be pressed in between the inner sleeve and the outer sleeve.

9. Coaxial plug-in connector arrangement according to claim 1, wherein the arresting element has a plurality of flexible tongues.

10. Coaxial plug-in connector arrangement according to claim 1, wherein the arresting element engages behind at least one of the inner sleeve and the outer sleeve in the axial direction.

11. Coaxial plug-in connector arrangement according to claim 1, wherein the arresting element is mountable on the inner sleeve and on the outer sleeve without the use of tools.

12. Coaxial plug-in connector arrangement according to claim 1, wherein one of:

the arresting element is adapted to be pressed onto the inner sleeve and/or to be locked to the inner sleeve, or the arresting element is adapted to be pressed onto the outer sleeve and/or to be locked to the outer sleeve.

13. Coaxial plug-in connector arrangement according to claim 1, wherein the arresting element has a plurality of deformable pressing wings that are arranged spaced apart from one another in a circumferential direction of the arresting element and are adapted to be pressed in between the inner sleeve and the outer sleeve.

14. Coaxial plug-in connector arrangement according to claim 13, wherein a radial extent of the pressing wings before the pressing-in into an accommodating space extending between the inner sleeve and the outer sleeve is greater, at least in certain regions, than a radial extent of the accommodating space.

15. Coaxial plug-in connector arrangement according to claim 14, wherein the pressing wings, before the pressing-in into the accommodating space extending between the inner sleeve and the outer sleeve, have a radial extent along their entire extent in the circumferential direction that is greater than the radial extent of the accommodating space.

16. Coaxial plug-in connector arrangement according to claim 14, wherein the pressing wings have a plurality of radial elevations situated at a spacing from one another in the circumferential direction of the arresting element, and, before the pressing-in into the accommodating space extending between the inner sleeve and the outer sleeve, have a radial extent in a region of the radial elevations that is greater than the radial extent of the accommodating space.

17. Coaxial plug-in connector arrangement according to claim 1, wherein the inner sleeve in the inserted state electrically contacts the outer sleeve only in a single contact area, the contact area being situated on an inner side of the outer sleeve and surrounding the inner sleeve in the circumferential direction.

18. Coaxial plug-in connector arrangement according to claim 1, wherein the arresting element has an electrically nonconductive spacing member which is insertable between an end portion of the outer sleeve facing away from the first contact pin and a region of the inner sleeve which, in the inserted state, is surrounded by the end portion.

19. Coaxial plug-in connector arrangement according to claim 1, wherein the arresting element has an annular space into which the outer sleeve is insertable by way of an end portion which faces away from the first contact pin.

20. Coaxial plug-in connector arrangement according to claim 19, wherein the end portion of the outer sleeve facing away from the first contact pin is pressable into the annular space.

21. Coaxial plug-in connector arrangement according claim 1, further comprising a spring element, which is clampable in the axial direction between mutually facing support surfaces of the inner sleeve and the outer sleeve.

22. Coaxial plug-in connector arrangement according to claim 21, wherein the spring element is clampable in a radial direction between the two mutually facing support surfaces of the inner sleeve and the outer sleeve.

23. Coaxial plug-in connector arrangement according to claim 21, wherein the spring element surrounds the inner sleeve in the circumferential direction.

24. Coaxial plug-in connector arrangement according to claim 21, wherein the spring element is formed as a ring-shaped elastomer part.

25. Coaxial plug-in connector arrangement according to claim 21, wherein an annular space, which extends between the inner sleeve and the outer sleeve, is sealable by means of the spring element.

26. Coaxial plug-in connector arrangement according to claim 21, wherein the spring element is configured as an O-ring or sealing sleeve.

27. Coaxial plug-in connector arrangement according to claim 1, wherein the arresting element has a plurality of detent wings which are distributed over a circumference of the arresting element, the wings being interlockable with at least one of the inner sleeve and the outer sleeve.

28. Coaxial plug-in connector arrangement according to claim 27, wherein the arresting element has a plurality of first detent wings, which extend into a region between the inner sleeve and the outer sleeve and interlock with locking elements that are located on an inner side of the outer sleeve.

29. Coaxial plug-in connector arrangement according to claim 27, wherein the arresting element has a plurality of second detent wings, which are distributed over the circumference of the arresting element and interlock with locking elements that are located on an outer side of the inner sleeve.

30. Coaxial plug-in connector arrangement according to claim 28, wherein:

the arresting element has a plurality of second detent wings, which are distributed over the circumference of the arresting element and interlock with locking elements that are located on an outer side of the inner sleeve, and the first and second detent wings are arranged alternatingly with respect to one another in a circumferential direction of the arresting element.

* * * * *